US006842731B2

(12) United States Patent
Miseki

(10) Patent No.: US 6,842,731 B2
(45) Date of Patent: Jan. 11, 2005

(54) PREDICTION PARAMETER ANALYSIS APPARATUS AND A PREDICTION PARAMETER ANALYSIS METHOD

(75) Inventor: Kimio Miseki, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/145,898

(22) Filed: May 16, 2002

(65) Prior Publication Data

US 2002/0184008 A1 Dec. 5, 2002

(30) Foreign Application Priority Data

May 18, 2001 (JP) ..... 2001-149564

(51) Int. Cl.[7] ..... G10L 19/00

(52) U.S. Cl. ..... 704/217; 704/219; 704/220; 704/223; 704/216

(58) Field of Search ..... 704/217, 223, 704/207, 208, 219, 218, 220, 229, 268, 233, 216

(56) References Cited

U.S. PATENT DOCUMENTS

| | | | | | |
|---|---|---|---|---|---|
| 4,538,234 | A | * | 8/1985 | Honda et al. | 704/229 |
| 5,307,405 | A | * | 4/1994 | Sih | 379/406.08 |
| 5,657,420 | A | * | 8/1997 | Jacobs et al. | 704/223 |
| 5,749,067 | A | * | 5/1998 | Barrett | 704/233 |
| 5,835,495 | A | * | 11/1998 | Ferriere | 370/465 |
| 5,926,786 | A | * | 7/1999 | McDonough et al. | 704/224 |

FOREIGN PATENT DOCUMENTS

| | | |
|---|---|---|
| JP | 5-63580 | 3/1993 |
| JP | 7-325583 | 12/1995 |
| JP | 8-509306 | 10/1996 |
| JP | 10-10230 | 1/1998 |
| JP | 10-254473 | 9/1998 |
| JP | 2000-330593 | 11/2000 |

OTHER PUBLICATIONS

J. Lukasiak, et al., IEEE ICASSP 2000, vol. 3, pp. 1471–1474, XP–010507628, "Linear Prediction Incorporating Simultaneous Masking" Jun. 5, 2000.

ITU–T Recommendation G.723.1, pp. 1–27, XP–001179339, "Dual Rate Speech Coder for Multimedia Communications Transmitting at 5.3 and 6.3 KBIT/S" Mar. 1996.

Redwan Salami, et al. "Design and Description of CS–ACELP: A Toll Quality 8 kb/s Speech Coder" IEEE Transactions of Speech and Audio Processing, vol. 6, No. 2, Mar. 1998, pp. 116–118.

ITU–T Recommendation G. 729–, General Aspects of Digital Transmission Systems, "Coding of Speech at 8 kbit/s Using Conjugate–Structure Algebraic–Code–Excited Linear–Prediction (CS–ACELP)" Mar. 1996.

TIA/EIA/IS–127 "Enhanced Variable Rate Codec, Speech Service Option 3 for Wideband Spread Spectrum Digital Systems" Jul. 19, 1996.

* cited by examiner

*Primary Examiner*—Vijay B. Chawan
(74) *Attorney, Agent, or Firm*—Oblon, Spivak, McClelland, Maier & Neustadt, P.C.

(57) ABSTRACT

A prediction parameter analysis apparatus comprises a windowing part which generates a short time input signal by subjecting an input signal or a signal derived from the input signal to windowing, a component removal part which removes an unnecessary component from the short time input signal to generate a modified short time input signal, an autocorrelation coefficient computation part which computes autocorrelation coefficients based on the modified short time input signal, and a prediction parameter computation part which computes prediction parameters based on the autocorrelation coefficients.

3 Claims, 7 Drawing Sheets

PREDICTION PARAMETER ANALYSIS APPARATUS AND A PREDICTION PARAMETER ANALYSIS METHOD

CROSS-REFERENCE TO RELATED APPLICATIONS

This application is based upon and claims the benefit of priority from the prior Japanese Patent Application No. 2001-149564, filed May 18, 2001, the entire contents of which are incorporated herein by reference.

BACKGROUND OF THE INVENTION

1. Field of the Invention

The present invention relates to a prediction parameter analysis apparatus or a prediction parameter analysis method to acquire prediction parameters from an input signal.

2. Description of the Related Art

In a field of audio encoding, LP parameters (linear prediction parameters) are used broadly as spectrum parameters used for expressing the envelope of a spectrum of a signal in speech coding and speech synthesis. An LP parameter analysis performed in the speech coding will be described as an example of prediction parameter analysis.

The conventional prediction parameter analysis is performed as follows.

At first, unnecessary low frequency components affecting analysis of prediction parameters are removed from an input signal by pre-processing. A high frequency pass filter realizes this processing with a cut off frequency of around 50–100 Hz typically. The input signal from which the unnecessary components were removed is windowed by a given time window w(n) to generate a short time input signal x(n) to be used for analysis. The time window is called windowing function or analysis window, and a Humming window is known well. The hybrid window that consists of a first part of half the humming window and a second part of a quarter of a cosine function is used well recently. The hybrid window is adopted in 8 kbit/s speech coding G.729 of an ITU-T recommendation (document 1 "Design and Description of CS-ACELP: A Toll Quality 8 kb/s Speech Coder" IEEE Trans. On Speech and Audio Processing, R. Salami other work, pp. 116–130, Vol. 6, No. 2, March 1998). As thus described, various types of time windows are used according to purpose.

Autocorrelation coefficients Rxx (i) are calculated by the following equation (1) using the short time input signal x(n).

$$Rxx(i) = \sum_{n=i}^{L-1} x(n)x(n-i) \tag{1}$$

where L indicates the length of the time window. The autocorrelation coefficients are referred to as merely 'autocorrelation' or 'autocorrelation function', but they are substantially the same.

It is performed generally to obtain prediction parameters using the autocorrelation coefficients obtained by the equation (1) or the autocorrelation coefficients subjected to modification by windowing the former autocorrelation coefficients by a fixed lag window. The modification of autocorrelation coefficients using the lag window is referred to the document 1.

A method known as Levinson-Durbin algorithm or recursive solution method of Durbin can be used in a case of obtaining the LP parameters as the prediction parameters. The document 2 "Digital Speech Processing" Tokai university publication meeting, Sadaoki Furui, pp. 75 is referred to in detail.

As thus described, the autocorrelation coefficients of the short time input signal x(n) obtained by windowing the input signal from which the unnecessary low frequency components are removed are calculated in the conventional prediction parameter analysis. However, as shown in waveforms of FIG. 1, the short time input signal cut out from the input signal ((a) in FIG. 1) by the time window is mixed with an unnecessary component (dc component shown by a dashed line in (b) in FIG. 1). Such an unnecessary component increases in case of prediction analysis using the short time window particularly. The unnecessary component affects the analysis of prediction parameters due to tendency to deviate to a low frequency band, resulting in incorrect prediction parameters. Furthermore, degree of mixture of such an unnecessary component varies depending upon the shape and phase of the input signal cut out by the window.

For the above reasons, the conventional prediction parameter analysis includes a problem that it is difficult to obtain the prediction parameters stably.

In the conventional prediction parameter analysis, an unnecessary component (DC component in particular) is mixed in the short time input signal. Therefore, the undesired prediction parameters occur.

BRIEF SUMMARY OF THE INVENTION

It is an object of the present invention to provide a prediction parameter analysis apparatus and a prediction parameter method having a high analysis efficiency and can keep mixture of an unnecessary component to a minimum.

According to an aspect of the present invention, there is provided a prediction parameter analysis apparatus comprising a windowing device configured to generate a short time input signal by subjecting an input signal or a signal derived from the input signal to windowing, a component removal device configured to remove an unnecessary component occurring by the windowing from the short time input signal to generate a modified short time input signal, an autocorrelation coefficient computation device configured to compute autocorrelation coefficients based on the modified short time input signal, and a prediction parameter computation device configured to compute prediction parameters based on the autocorrelation coefficients.

According to another aspect of the invention, there is provided a prediction parameter analysis method comprising subjecting an input signal or a signal derived from the input signal to windowing to generate a short time input signal, removing an unnecessary component occurring by the windowing from the short time input signal to generate a modified short time input signal, computing autocorrelation coefficients based on the modified short time input signal, and computing prediction parameters based on the autocorrelation coefficients.

DETAILED DESCRIPTION OF THE INVENTION

Figure 1:
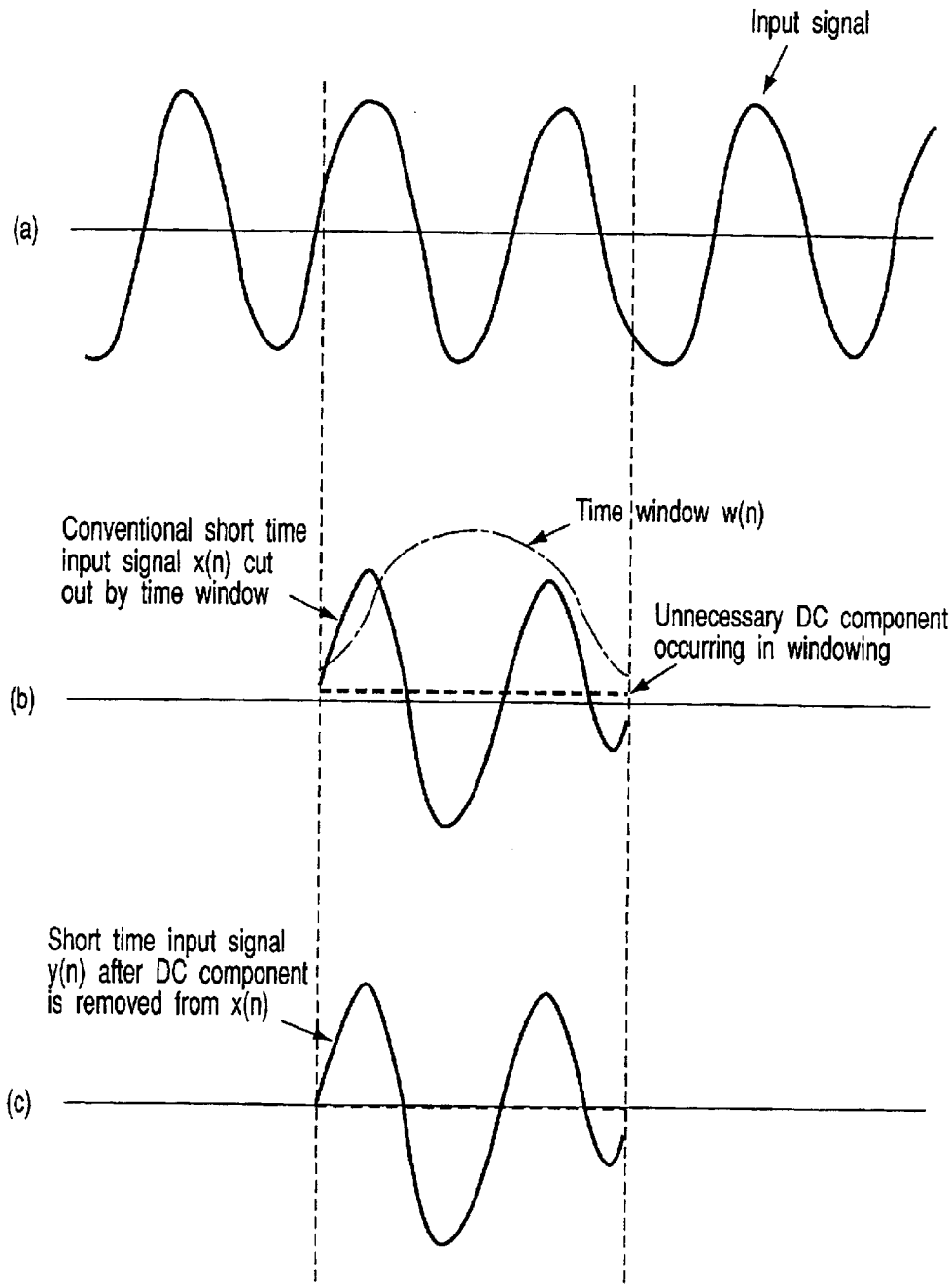
FIG. 1 shows waveforms for explaining a principle of prediction parameter analysis.

FIG. 1 shows a waveform for explaining a principle of prediction parameter analysis based on the first embodiment of the present invention.

A waveform (a) represents a waveform of an input signal input to a prediction parameter analysis apparatus. The input signal is a signal that the unnecessary low frequency component affecting a prediction parameter analysis is removed from an actual input signal in preprocessing. The preprocessing is realized using a high pass filter with a cutoff frequency of around 50–100 Hz typically. The input signal (shown by (a) in FIG. 1) from which the unnecessary component is removed is cut out by windowing in units of a given length (10 msec to 20 msec). In other words, the input signal is windowed by a time window w (n), to be cut out as a short time input signal x(n) (shown by (b) in FIG. 1). In this case, the input signal is windowed so that harmful effect affecting the frames on both ends of the extracted frame is decreased. As one example, a Humming window or a hybrid window is used.

It is a conventional method to calculate autocorrelation directly using the short time input signal x(n). However, the short time input signal x(n) is mixed with the unnecessary component (DC component contained in the waveform (b) in FIG. 1). When the autocorrelation is computed using the short time input signal containing the DC component, the DC component is added to a true spectrum, resulting in affecting the spectrum undesirably.

The present embodiment does not compute directly autocorrelation coefficients using the short time input signal, but detects how much unnecessary component, e.g., DC component occurring in windowing is mixed in the short time input signal and removes the detected DC component. As the method for removing the unnecessary component, there is a method for subtracting the DC component from the whole of the short time input signal so that the DC component becomes zero.

The signal obtained by removing the unnecessary component from the short time input signal as described above is a modified short time input signal y(n) (shown by (c) in FIG. 1). At last, the autocorrelation coefficients are calculated using the modified short time input signal y(n), and prediction parameters are computed based on the autocorrelation coefficients.

Figure 2:
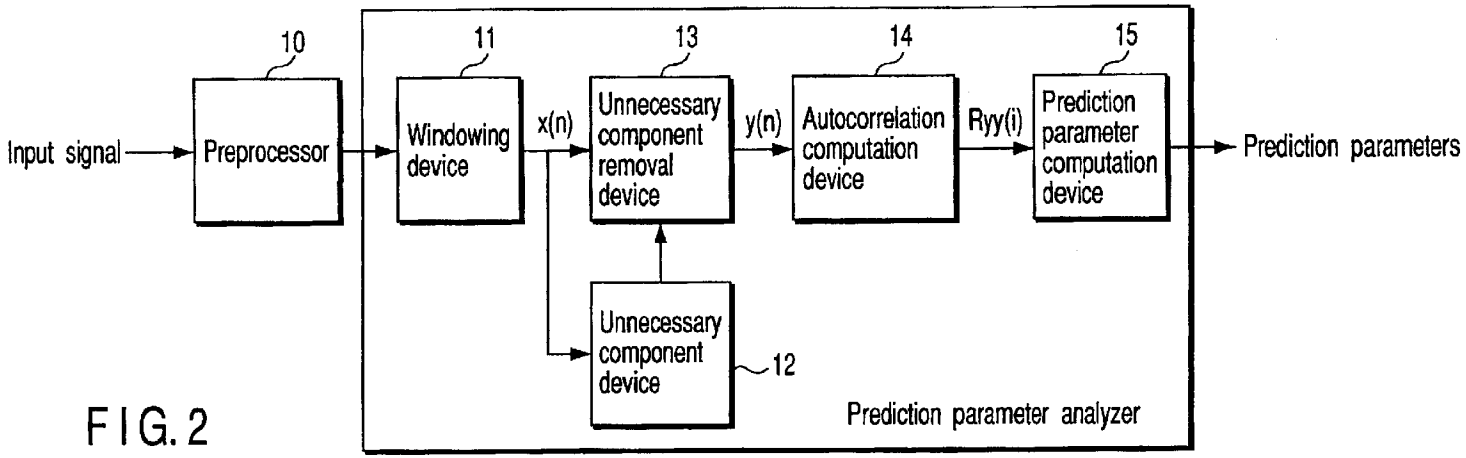
FIG. 2 shows a block diagram of a prediction parameter analysis apparatus according to the first embodiment of the present invention.

According to the present embodiment, since the mixture of the unnecessary component in the short time input signal is prevented, the prediction parameters of high precision can be obtained. A prediction parameter analysis apparatus according to an embodiment of the present invention will be described referring to FIG. 2. In FIG. 2, a preprocessor 10 is supplied with an input speech signal in units of a frame, and subjects it to preprocessing, using a high pass filter with a cut off frequency of around 50–100 Hz, for example. When the preprocessed input signal is input to a windowing device 11, the input signal is subjected to a time window w(n) (n=0, 1, . . . , L−1) to obtain a short time input signal x(n) (n=0, 1, . . . , L−1), where L indicates the length of the time window.

An unnecessary component estimation device 12 analyzes an unnecessary component included in the short time input signal x(n), and outputs an estimation signal to an unnecessary component remover 13. A main component of the unnecessary component included in the short time input signal x(n) is a DC component. One example of an evaluation of the DC component can be performed as follows.

$$dc=f(x(n)) \tag{2}$$

where dc indicates an estimation signal of the DC component, f( ) indicates a function of the short time input signal x(n). One example of f( ) is as follows:

$$dc = k_{dc}\left[\frac{1}{L}\sum_{n=0}^{L-1} x(n)\right] \tag{3}$$

where, [ ] corresponds to an average value of the short time input signal x(n). It is possible to estimate the DC component using the average value and an adjustment parameter $k_{dc}$. The adjustment parameter $k_{dc}$ is set to a value between zero and around 1. A theoretical optimum value is $k_{dc}=1$ (makes the average value into an estimation signal of the DC component). The unnecessary component remover 13 generates a short time input signal y(n) obtained by modifying the short time input signal x(n) based on the estimation signal from the unnecessary component estimation device 12. This concrete method includes a step of removing the estimation signal of the unnecessary component from, for example, the short time input signal x(n) as follows.

$$y(n)=x(n)-dc \tag{4}$$

$$n=0,1,\ldots,L-1$$

The method for removing the DC component from the short time input signal x(n) is described here. However, it is possible to remove an unnecessary low frequency component by applying a given high pass filter (=low frequency blocking filter) to the short time input signal x(n), and use it as the modified short time input signal y(n). In this case, the computation for filtering is necessary, but the estimation signal of the unnecessary component may not be used. Thus, the unnecessary component estimation device 12 is not needed in such a case.

An autocorrelation computation device 14 computes autocorrelation coefficients from the modified short time input signal y(n) according to the following equation, for example.

$$Ryy(i) = \sum_{n=i}^{L-1} y(n)y(n-i) \tag{5}$$

A prediction parameter computation device 15 computes prediction parameters based on the autocorrelation coefficients Ryy(i). After the autocorrelation coefficients are computed as described above, the prediction parameters are computed by the method similar to the conventional method. In other words, the prediction parameters are generated using autocorrelation coefficients obtained by the equation (5) or modified autocorrelation coefficients obtained by subjecting the autocorrelation coefficients to a fixed lag window to stabilize the analysis. The LP parameters as the prediction parameters are computed-by solving the following linear equation.

$$\Phi\alpha=\phi \tag{6}$$

where $\Phi$ indicates an autocorrelation matrix formed by autocorrelation coefficients $\phi i$=Ryy(i) (or the modified autocorrelation coefficients subjected to fixed modification by applying the autocorrelation coefficients to the fixed lag window). N indicates the order of the LPC parameters.

$$\Phi = \begin{bmatrix} \phi_0 & \phi_1 & \cdots & \phi_{N-1} \\ \phi_1 & \phi_0 & \ddots & \vdots \\ \vdots & \ddots & \ddots & \phi_1 \\ \phi_{N-1} & \cdots & \phi_1 & \phi_0 \end{bmatrix} \tag{7}$$

$$\alpha = [\alpha_1,\ \alpha_2,\ \cdots,\ \alpha_N]^T$$

$$\varphi = [\phi_1,\ \phi_2,\ \cdots,\ \phi_N]^T$$

where T indicates the transpose of matrix.

The method for obtaining the LP parameters $\{\alpha_1\}$ from the equation (6) should be referred to the document 2.

Figure 3:
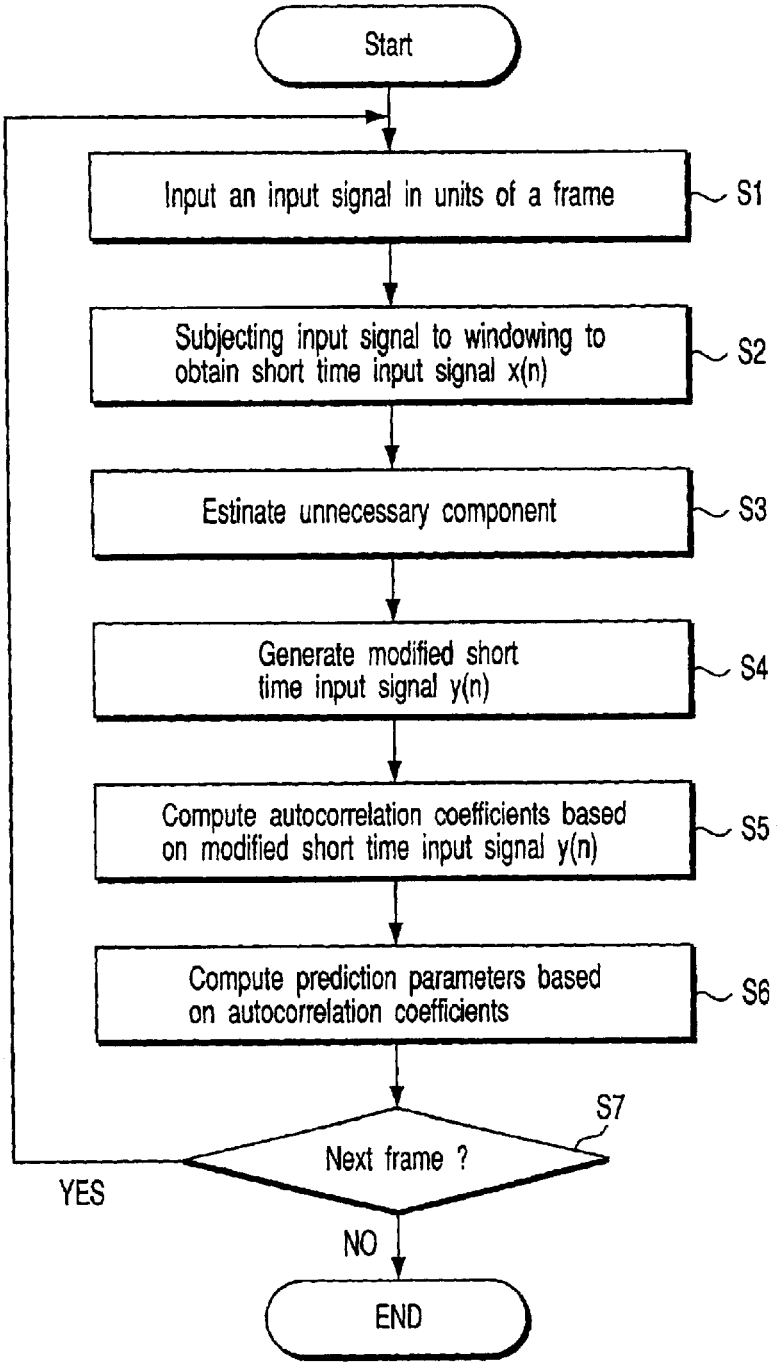
FIG. 3 shows a flowchart for explaining a prediction parameter analysis method executed by the prediction parameter analysis apparatus according to the first embodiment.

The above is an analysis example for the prediction parameters according to the present embodiment. The processing related to the first embodiment of the present invention will be explained in conjunction with a flowchart of FIG. 3.

At first, an input speech signal is input in units of a frame (S1). It is desirable for the input signal to use an input signal preprocessed by a high frequency pass filter whose cut off frequency is around 50–100 Hz, for example. A short time input signal x(n) is generated by subjecting the preprocessed input signal to a time window w(n) (S2). An unnecessary component included in the short time input signal x(n) is estimated (S3). A modified short time input signal y(n) is generated from the short time input signal x(n) (S4).

Autocorrelation coefficients are computed based on the modified short time input signal y(n) (S5 ). Prediction parameters are computed from the autocorrelation coefficients (S6), and output as the prediction parameters of the input signal corresponding to a frame. The prediction parameter analysis process of the input signal that is input in units of a frame (in a case of a speech signal, a representative frame length in sampling 8 kHz is within a range of 10–20 msec) by performing a process of steps S1 to S6 is completed. The serial processes are performed every frame to perform the process of the input signal input continuously (S7).

(The Second Embodiment)

Figure 4:
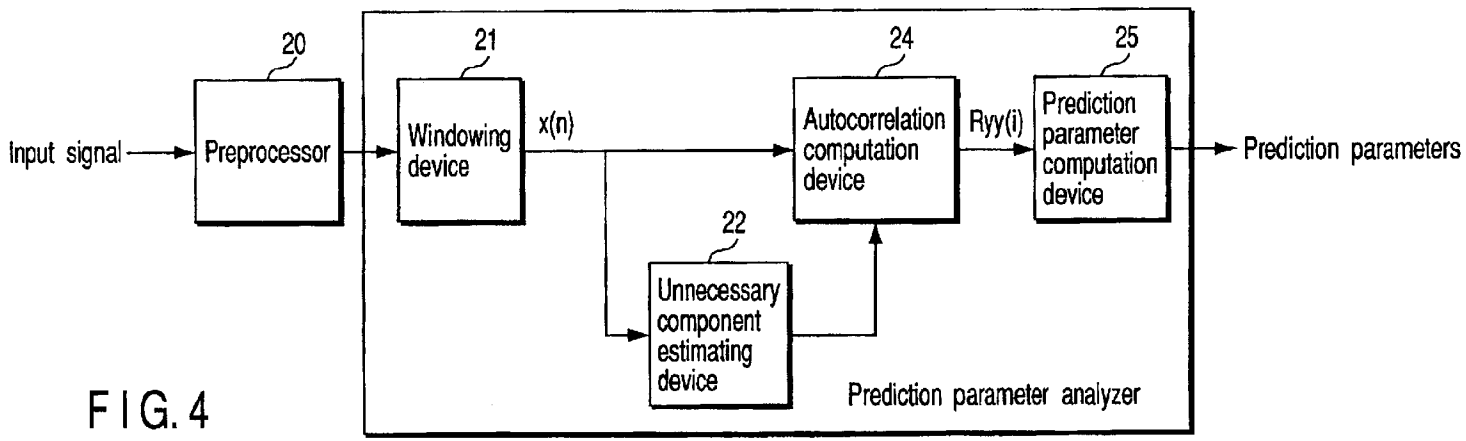
FIG. 4 shows a block diagram of a prediction parameter analysis apparatus according to the second embodiment of the present invention.

In the first embodiment, the DC component is directly removed from the short time input signal. In the second embodiment, the affection due to the DC component is excluded in a level of the autocorrelation. FIG. 4 shows a prediction parameter analysis apparatus related to the second embodiment. According to this, the preprocessor 20 preprocesses the input signal similarly to the first embodiment, and input the preprocessed input signal to a widowing device 21. The windowing device 21 cuts out a short time input signal by subjecting the preprocessed signal to windowing. The unnecessary component estimation device 22 analyzes an unnecessary component included in the short time input signal x(n), to generate an estimation signal, and outputs it to an autocorrelation computation device 24. The short time input signal x(n) is sent to the autocorrelation calculation device 24, too. For example, in the short time input signal input to the autocorrelation computation device 24 is included an unnecessary component, e.g., DC component occurring when subjecting the input signal to windowing. However, the autocorrelation computation device 24 removes this unnecessary component in a level of autocorrelation, using the estimation signal from the unnecessary component estimation device 22. Therefore, the autocorrelation computation device 24 outputs autocorrelation coefficients Ryy(i) which are not affected by the unnecessary component. The prediction parameter computation device 25 computes prediction parameters based on the autocorrelation coefficients Ryy (i).

Figure 5:
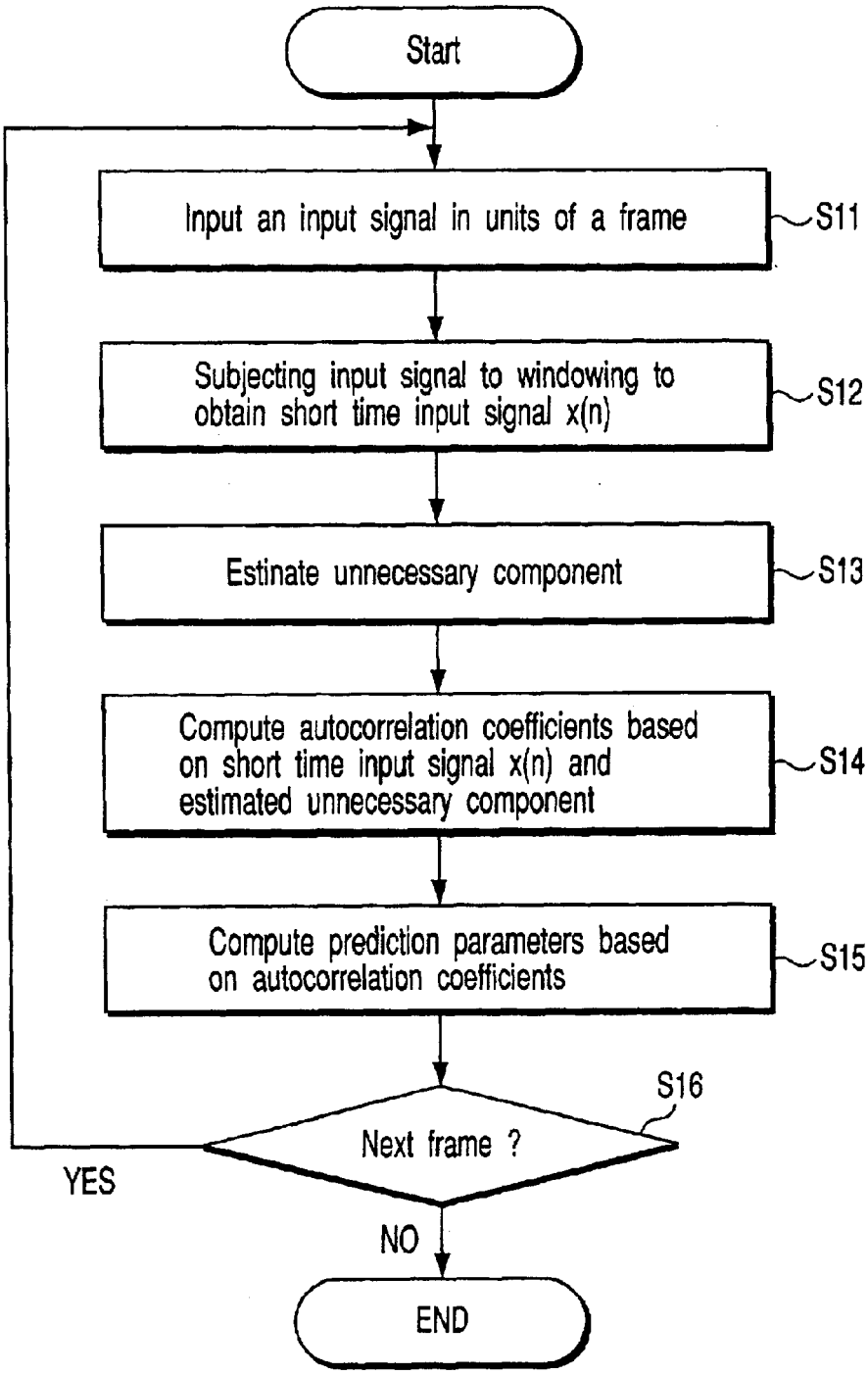
FIG. 5 shows a flowchart for explaining a prediction parameter analysis method executed by the prediction parameter analysis apparatus of the second embodiment.

FIG. 5 shows a flowchart for explaining a prediction parameter analysis method of the second embodiment of the present invention. According to this embodiment, a method is provided which generates autocorrelation coefficients used for computation of prediction parameters without generating a modified short time input signal y(n), in light of the unnecessary component which occurs by subjecting the input signal to the time window.

According to this method, an input speech is input in units of a frame (S11). A short time input signal x(n) is obtained by subjecting the preprocessed input signal to a time window w(n) (S12). Then, an unnecessary component included in the short time input signal x(n) is estimated (S13). Autocorrelation coefficients are obtained by the estimated unnecessary component and the short time input signal x(n) (S15). Prediction parameters are computed from the autocorrelation coefficients (S16), and output as the prediction parameters of the input signal corresponding to a frame.

The prediction parameter analysis process of the input signal input in units of a frame (in a case of a speech signal, a representative frame length in sampling 8 kHz is within a range of 10–20 msec) by performing the above steps is completed. The serial processes are performed every frame to perform the process of the input signal input continuously (S17).

As thus described, any method for generating autocorrelation coefficients used for computing prediction parameters in light of the unnecessary component occurring when subjecting the input signal to the time window is included in the present invention.

As a prediction parameter extract method is explained a method for extracting linear prediction parameters, but it is not limited to this method. In other words, if the prediction parameters can be obtained by autocorrelation coefficients, the present invention is not limited whether the prediction parameters are linear or non-linear. The prediction parameter analysis method of the present invention can be applied to any analysis method for prediction parameters (synthesis filter based on the prediction parameters).

(The Third Embodiment)

Figure 6:
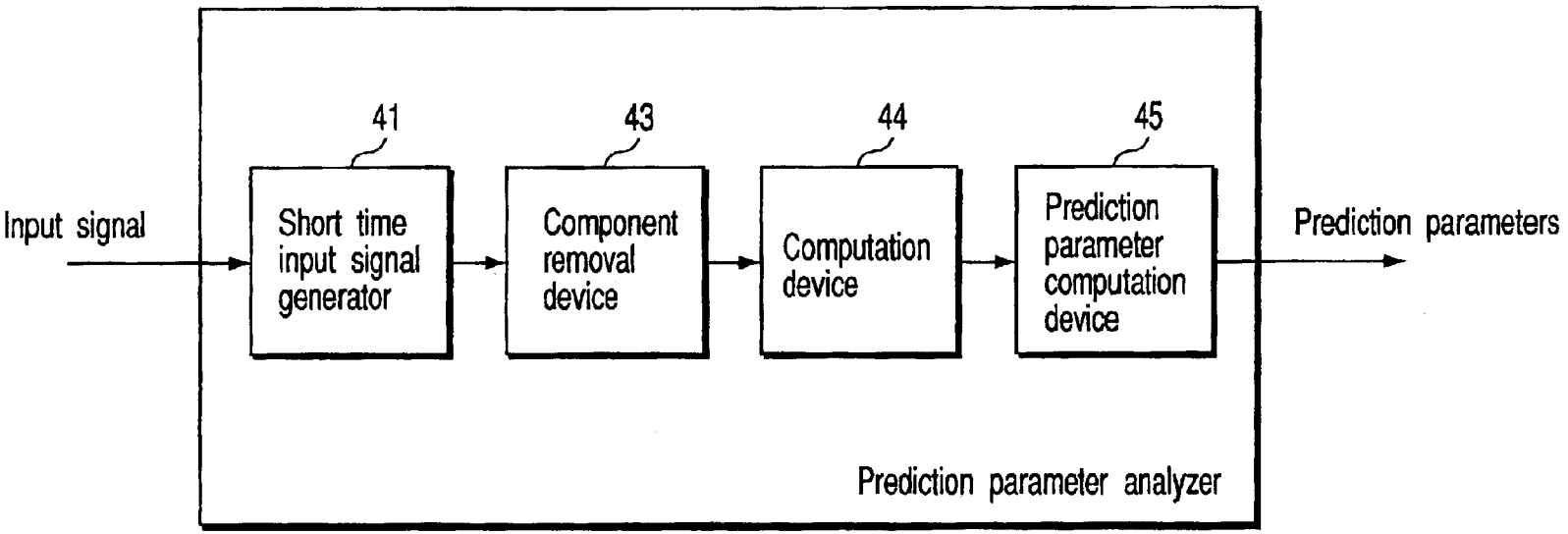
FIG. 6 shows a block diagram of a prediction parameter analysis apparatus according to the third embodiment of the present invention.

FIG. 6 shows a prediction parameter analysis apparatus of the third embodiment. According to the third embodiment, a prediction parameter analysis device comprises a short time input signal generator 41 which generates a short time input signal from an input signal or a signal deriving from the input signal, a component removal device 43 which remove DC components or predetermined frequency band components from the short time input signal, an autocorrelation computation device 44 which computes autocorrelation coefficients based on a modified short time input signal provided from the component removal device 43, and a prediction parameter computation device 45 which computes prediction parameters based on the autocorrelation coefficients.

Figure 7:
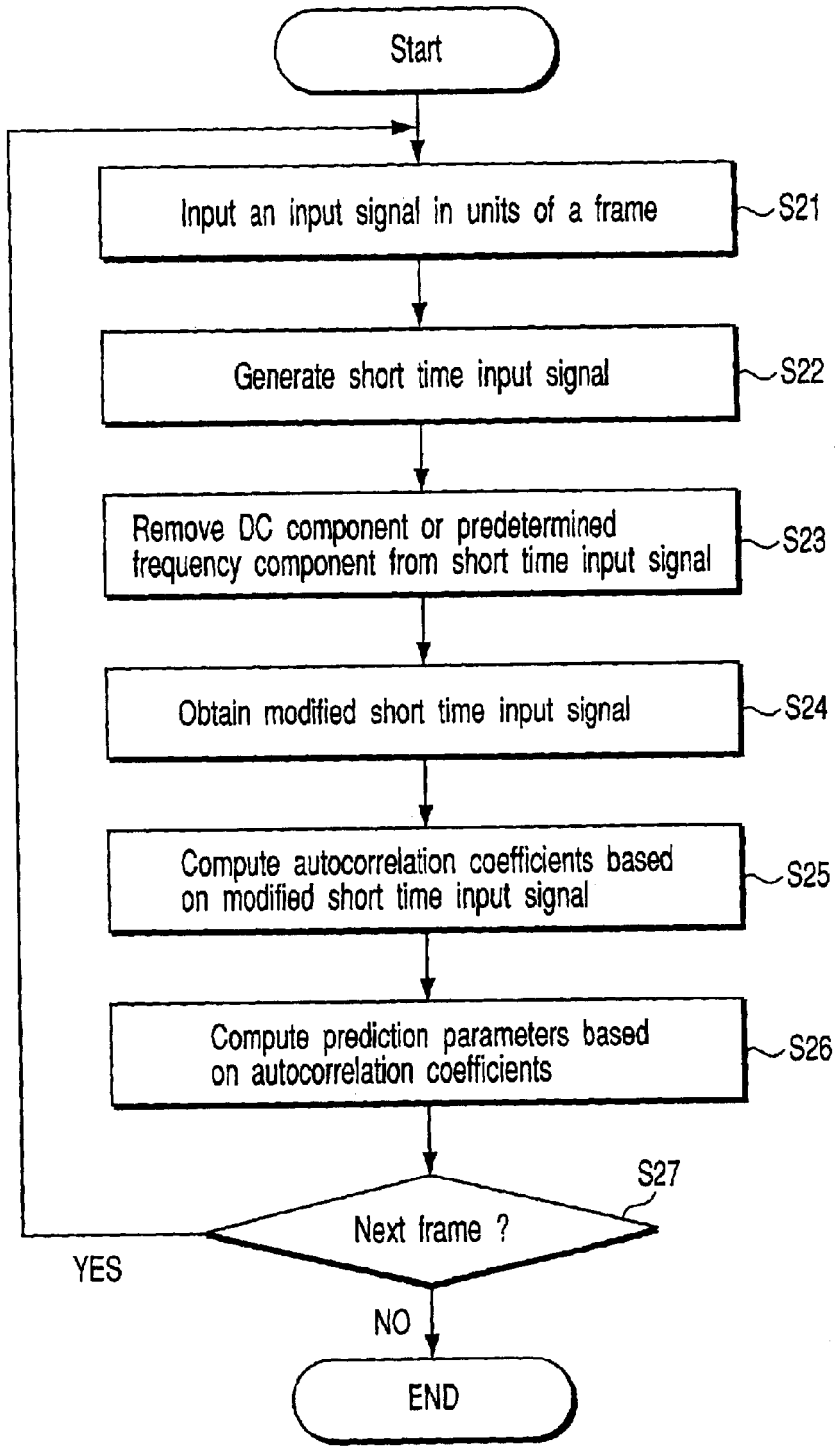
FIG. 7 shows a flowchart for explaining the prediction parameter analysis method executed by the prediction parameter analysis apparatus of the third embodiment.

FIG. 7 shows a flowchart for explaining a prediction parameter analysis method of the third embodiment of the present invention. At first, an input signal is input to the short time input signal generator 41 of the prediction parameter analysis device (S21). The short time input signal generator 41 generates a short time input signal corresponding to the input signal (S22). When this short time input signal is input to the component removal device 43, DC or predetermined frequency components are removed from the short time input signal (S23). As a result, a modified short time input signal is output from the component removal device 43 (S24). When this modified short time input signal is input to the autocorrelation computation device 44, the autocorrelation computation device 44 computes autocorrelation coefficients based on the modified short time input signal (S25). When the autocorrelation coefficients are input to the prediction parameter computation device 45, the prediction parameters are computed on the basis of the autocorrelation coefficients (S26). Thereafter, the next frame is taken in. In this time, if there is no next frame, the process is finished. If the next frame is taken in, the process returns to step S21.

Figure 8A:
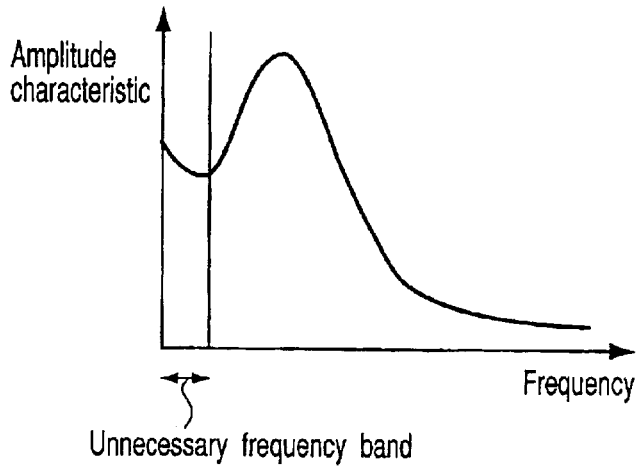
FIG. 8A PRIOR ART
FIGS. 8A and 8B show frequency characteristics of analysis filters which are provided by a conventional method and a method of the present invention.
Figure 8B:
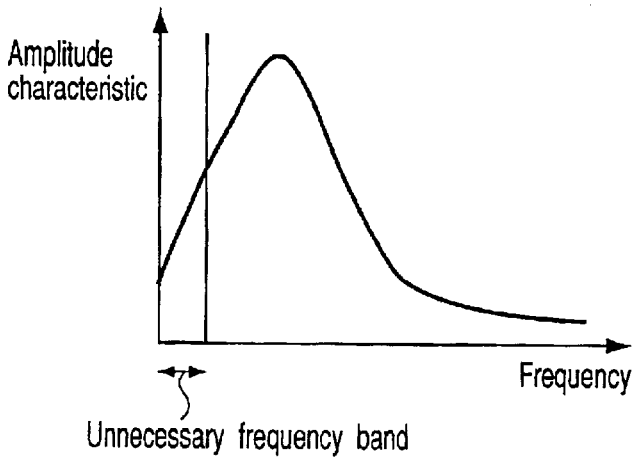

In the prediction parameter analysis apparatus of the present embodiment described above, an inverse filter of the prediction filter based on the prediction parameters (or encoded prediction parameters) is called a synthesis filter and can provide the envelope of the spectrum of the input signal used for analysis. FIG. 8A shows a frequency characteristic of a synthesis filter based on the prediction parameters provided by conventional prediction parameter analysis. FIG. 8B shows a frequency characteristic of a synthesis filter based on the prediction parameters provided by the method of the present embodiment. As understood from comparison between FIG. 8A and FIG. 8B, the unnecessary low frequency components occurring in windowing lowers in the synthesis filter provided by the method of the present embodiment in comparison with the conventional method. Therefore, by using the prediction parameters provided by the method of the present embodiment, the speech quality of the speech coding or the speech synthesis can be improved.

Figure 9:
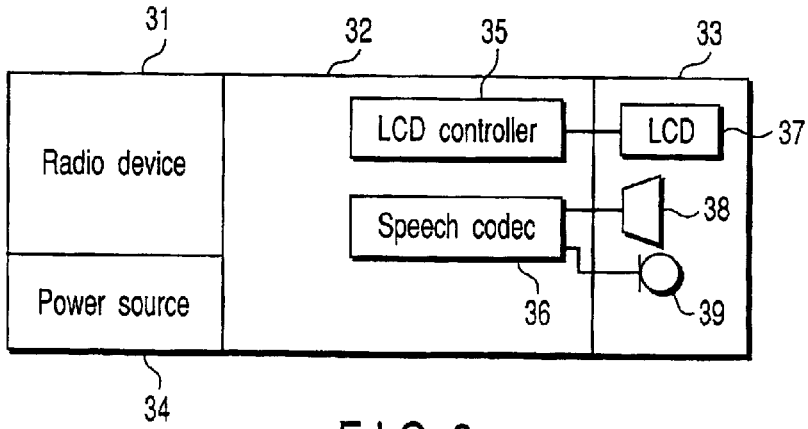
FIG. 9 shows block diagram of the portable telephone that applies the present invention.

FIG. 9 shows a portable terminal such as portable telephone to which the prediction parameter analysis apparatus described above is applied. This portable telephone comprises a radio device 31, a baseband device 32, an input-output device 33 and a power supply device 34. The baseband device 32 is provided with a LCD controller 35 to control a liquid crystal display (LCD) 37 of the input-output device 33 and a speech codec 36 connected to a speaker 38 and a microphone 39. The prediction parameter analysis apparatus according to the embodiment of the invention is applied to a LPC circuit included in the speech codec 36 to improve the speech quality.

According to the present invention as described above, since the unnecessary component such as a DC component occurring in windowing of the input signal is removed, the prediction parameters stabilized for the stationary input signal can be obtained in the prediction parameter analysis. Accordingly, the present invention can utilize a signal processing for performing prediction analysis such as speech coding, audio encoding, a speech synthesis, and speech recognition.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A prediction parameter analysis apparatus comprising:

a windowing part configured to subject an input signal or a signal derived from the input signal to windowing by a prediction analysis window to generate a short time input signal;

an estimation part configured to calculate an estimated unnecessary DC component, which is caused by the windowing and included in the short time input signal, based on an average value of the short time input signal and a parameter Kdc such that ($0<Kdc<1$);

an autocorrelation coefficient computation part configured to compute autocorrelation coefficients using the estimated unnecessary DC component and the short time input signal; and a prediction parameter computation part configured to compute prediction parameters based on the autocorrelation coefficients.

2. A prediction parameter analysis apparatus comprising:

means for subjecting an input signal or a signal derived from the input signal to windowing by a prediction analysis window to generate a short time input signal;

means for calculating an estimated unnecessary DC component, which caused by the windowing and included in the short time input signal, based on an average value of the short time input signal and a parameter Kdc such that ($0<Kdc<1$);

means for computing autocorrelation coefficients using the estimated unnecessary DC component and the short time input signal; and means for computing prediction parameters based on the autocorrelation coefficients.

3. A prediction parameter analysis method comprising:

subjecting an input signal or a signal derived from the input signal windowing by a prediction analysis window to generate a short time input signal;

calculating an estimated unnecessary DC component which is caused by the windowing and included in the short time input signal, based on an average value of the short time input signal and a parameter Kdc such that ($0<Kdc<1$);

computing autocorrelation coefficients using the estimated unnecessary DC component and the short time input signal; and computing prediction parameters based on the autocorrelation coefficients.

* * * * *